US006962150B2

(12) United States Patent
Booth

(10) Patent No.: US 6,962,150 B2
(45) Date of Patent: Nov. 8, 2005

(54) POOL HEATING SYSTEM

(76) Inventor: David Allen Booth, 36 Percy Crescent, Port Perry, Ontario (CA) L9L 1B4

( * ) Notice: Subject to any disclaimer, the term of this patent is extended or adjusted under 35 U.S.C. 154(b) by 0 days.

(21) Appl. No.: 10/721,040

(22) Filed: Nov. 25, 2003

(65) Prior Publication Data

US 2004/0129790 A1 Jul. 8, 2004

(51) Int. Cl.[7] ..... F24J 2/00; F24H 9/00
(52) U.S. Cl. ..... 126/563; 165/48.1; 237/2 B
(58) Field of Search ..... 126/561–563, 126/629–634, 651, 621–622, 373.1, 376.1; 165/48.1, 48.2, 45; 237/2 B; 454/229, 329, 454/338, 236, 231, 234; 236/91 R, 91 A; 4/493

(56) References Cited

U.S. PATENT DOCUMENTS

| | | | | |
|---|---|---|---|---|
| 4,051,999 A | * | 10/1977 | Granger et al. | 126/591 |
| 4,241,725 A | * | 12/1980 | Emon et al. | 126/638 |
| 4,378,787 A | * | 4/1983 | Fleischmann | 126/589 |
| 4,502,467 A | * | 3/1985 | Smith | 126/586 |
| 5,014,770 A | * | 5/1991 | Palmer | 165/48.2 |
| 5,452,710 A | * | 9/1995 | Palmer | 165/48.2 |
| 5,632,677 A | * | 5/1997 | Elkins | 454/329 |
| 5,975,192 A | * | 11/1999 | Moratalla et al. | 165/45 |
| 6,126,540 A | * | 10/2000 | Janu et al. | 454/229 |

FOREIGN PATENT DOCUMENTS

| | | | | |
|---|---|---|---|---|
| JP | 61-107050 A | * | 5/1986 | F24J 2/04 |

* cited by examiner

*Primary Examiner*—Josiah C. Cocks
(74) *Attorney, Agent, or Firm*—Stikeman Elliott LLP; Eugene F. Derenyi

(57) ABSTRACT

A modular swimming pool water heating system including a first casing for mounting in an attic of a building, a heat exchange unit removably mounted in said first casing, an opening in said first casing permitting access to the interior of the first casing for receiving said heat exchanger, a cover removably mounted on said casing for closing said opening, an inlet manifold on said heat exchanger for introducing swimming pool water into said heat exchanger, said inlet manifold extending through said cover on said first casing when the first casing is closed, an outlet manifold on said heat exchanger for returning water to a swimming pool, said outlet manifold extending through said cover on said first casing when the first casing is closed, inlet sleeves for removable attachment to one side of said first casing for introducing air into the casing, fan units for removable mounting on a second side of said first casing opposite said one side for drawing air into said first casing and through said heat exchange unit, and elongated ducts for connection to said inlet sleeves for receiving warm attic air from locations remote from said first casing and feeding said air to said first casing for passage through said heat exchange unit to heat any pool water circulating therethrough.

3 Claims, 5 Drawing Sheets

POOL HEATING SYSTEM

CROSS REFERENCE TO RELATED APPLICATIONS

This application claims priority from Canadian Patent application serial no. 2,413,348, filed Nov. 29, 2002.

BACKGROUND OF THE INVENTION

1. Field of the Invention

This invention relates to a swimming pool heating system, and in particular to a modular, swimming pool heating system for installation in the attic of a house.

2. Discussion of the Prior Art

Particularly in northern climes, for the sake of comfort, it is often necessary to heat the water in swimming pools. While air temperatures during the day can be quite high, night temperatures are frequently low enough to cool a pool well below the comfort level. Accordingly, it is often necessary to heat the pool during the day to raise the water temperature to a comfortable level.

A variety of systems have been proposed for using warm attic air for heating. One such system is described in U.S. Pat. No. 5,014,770, issued to E. G. Palmer on May 14, 1991. The Palmer patent discloses a system including a heat exchanger mounted in the attic of a house. Swimming pool water is circulated from the pool through the heat exchanger where it is heated, and then returned to the pool. In the Palmer system, the heat exchanger is mounted in a casing, which includes an air inlet and an air outlet in close proximity to each other. Thus, cool air discharged through the outlet is re-circulated to the inlet which reduces the efficiency of the unit. As a result, much of the hot air stored in attic is not recovered by the Palmer unit. Moreover, the Palmer unit is a somewhat large single fan assembly, which is too large to pass through the standard opening into most attics without modification to the opening.

GENERAL DESCRIPTION OF THE INVENTION

The object of the present invention is to provide solutions to the problems inherent to existing pool water heating systems by providing a simple, modular system for mounting in an attic which effectively uses a relatively large amount of the heat available in the attic.

Accordingly the invention relates to a modular swimming pool water heating system comprising a first casing for mounting in an attic of a building;

- a heat exchange unit removably mounted in said first casing;
- an opening in said first casing permitting access to the interior of the first casing for receiving said heat exchanger;
- a cover removably mounted on said casing for closing said opening;
- an inlet manifold on said heat exchanger for introducing swimming pool water into said heat exchanger, said inlet manifold extending through said cover on said first casing when the first casing is closed;
- an outlet manifold on said heat exchanger for returning water to a swimming pool, said outlet manifold extending through said cover on said first casing when the first casing is closed;
- inlet sleeves for removable attachment to one side of said first casing for introducing air into the casing;

- fan units for removable mounting on a second side of said first casing opposite said one side for drawing air into said first casing and through said heat exchange unit; and
- elongated ducts for connection to said inlet sleeves for receiving warm attic air from locations remote from said first casing and feeding said air to said first casing for passage through said heat exchange unit to heat any pool water circulating therethrough.

BRIEF DESCRIPTION OF THE INVENTION

The invention is described below in greater detail with reference to the accompanying drawings, wherein.

DESCRIPTION OF THE PREFERRED EMBODIMENT

Figure 1:
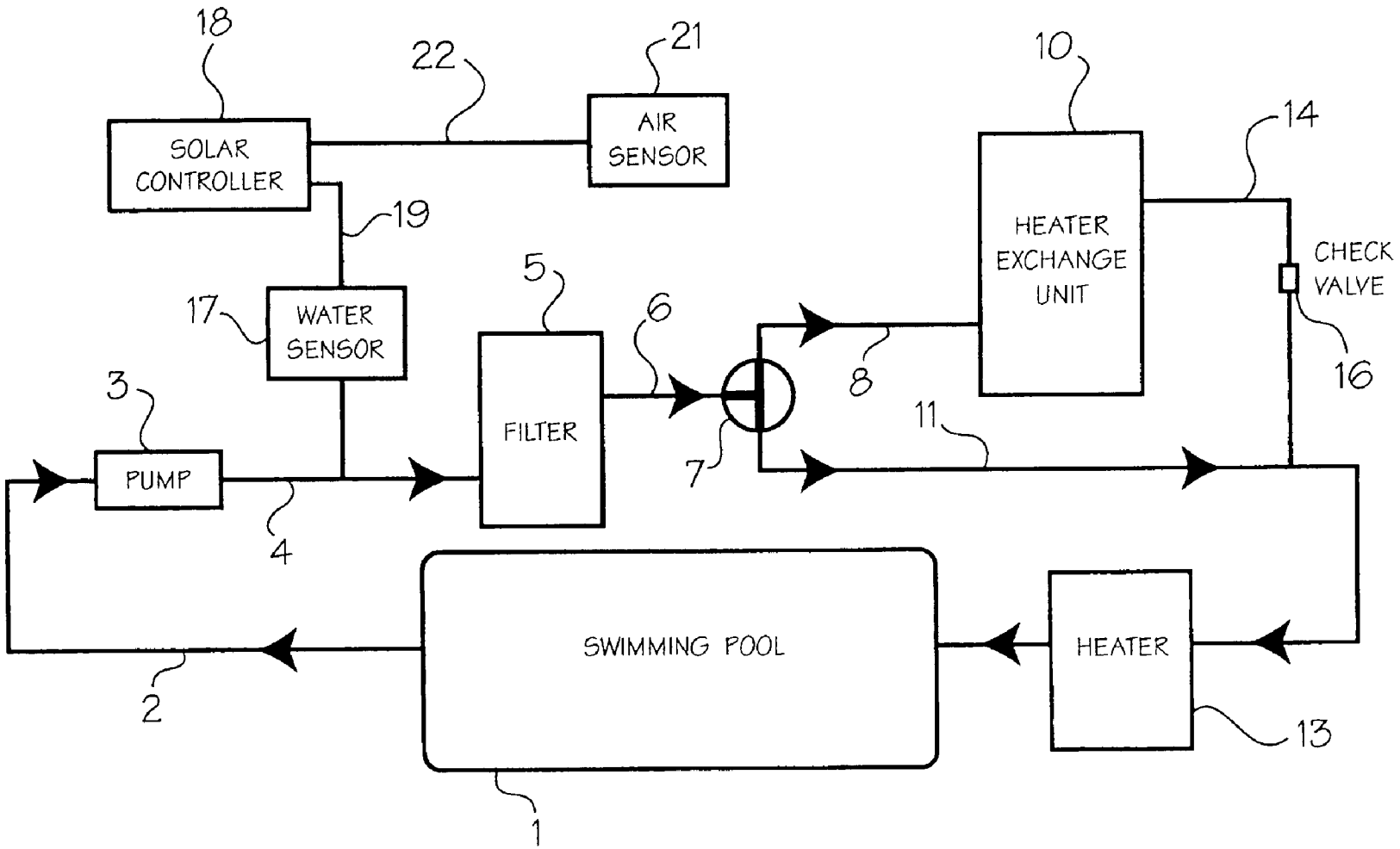
FIG. 1 is schematic block diagram of a system for heating swimming pool water is accordance with the invention.

With reference to FIG. 1, the system of the present invention is designed to heat water from a swimming pool 1. Water discharged via the skimmer and main drain from the pool flows through a pipe 2, which is preferably a PVC pipe of at least 1.5" internal diameter using a conventional pump 3 having at least one horsepower. The water passes through a pipe 4 to the pool filter 5. From the filter 5, the water flows through a pipe 6 and a three-way valve 7 either via pipe 8 to the heat exchange unit 10 of the present invention or via pipe 11 to an electric or gas pool heater 13, which is optional. Water discharge from the unit 10 flows through a pipe 14 containing a check valve 16 to the pipe 11, and is returned to the pool 1 via the heater 13.

The temperature of the water in the pipe 4 is sensed by a sensor 17, which is connected to a controller 18 by a line 19. The temperature of the air in an attic is monitored by a sensor 21, which is connected to the controller 18 by a line 22. The controller 18 operates the valve 7 to cause water from the pool to flow to the heat exchange unit 10, or to bypass the unit and flow directly back to the pool 1 or through the electric heater back to the pool. If the difference between the temperatures detected by the sensors 17 and 21, i.e. the difference between the pool water temperature and the air in the attic is less than approximately 20° F., water from the pool 1 bypasses the heat exchange unit 10. Automation of the system is achieved using a Compool (trademark) LX2201T control system consisting of a Compool three-way valve, a Compool CV A24T automatic valve actuator, a Compool LX220 controller, a 20 amp relay and modified Compool 10 K air and water temperature sensors. The air sensor, as modified by the inventor, includes an in line 200 ohm, 5 watt resistor, which is wired in series with the sensor to increase the temperature differential required to actuate the valve 7 and turn on the unit 10 at approximately a 20° F. temperature differential. This ensures that the system operates at maximum efficiency, and allows for proper heat build up in the attic. Conventional solar control sensors would switch the unit on at a temperature difference of approximately 6° F. which is not sufficient for proper operation of the heat exchange unit 10.

Figure 2:
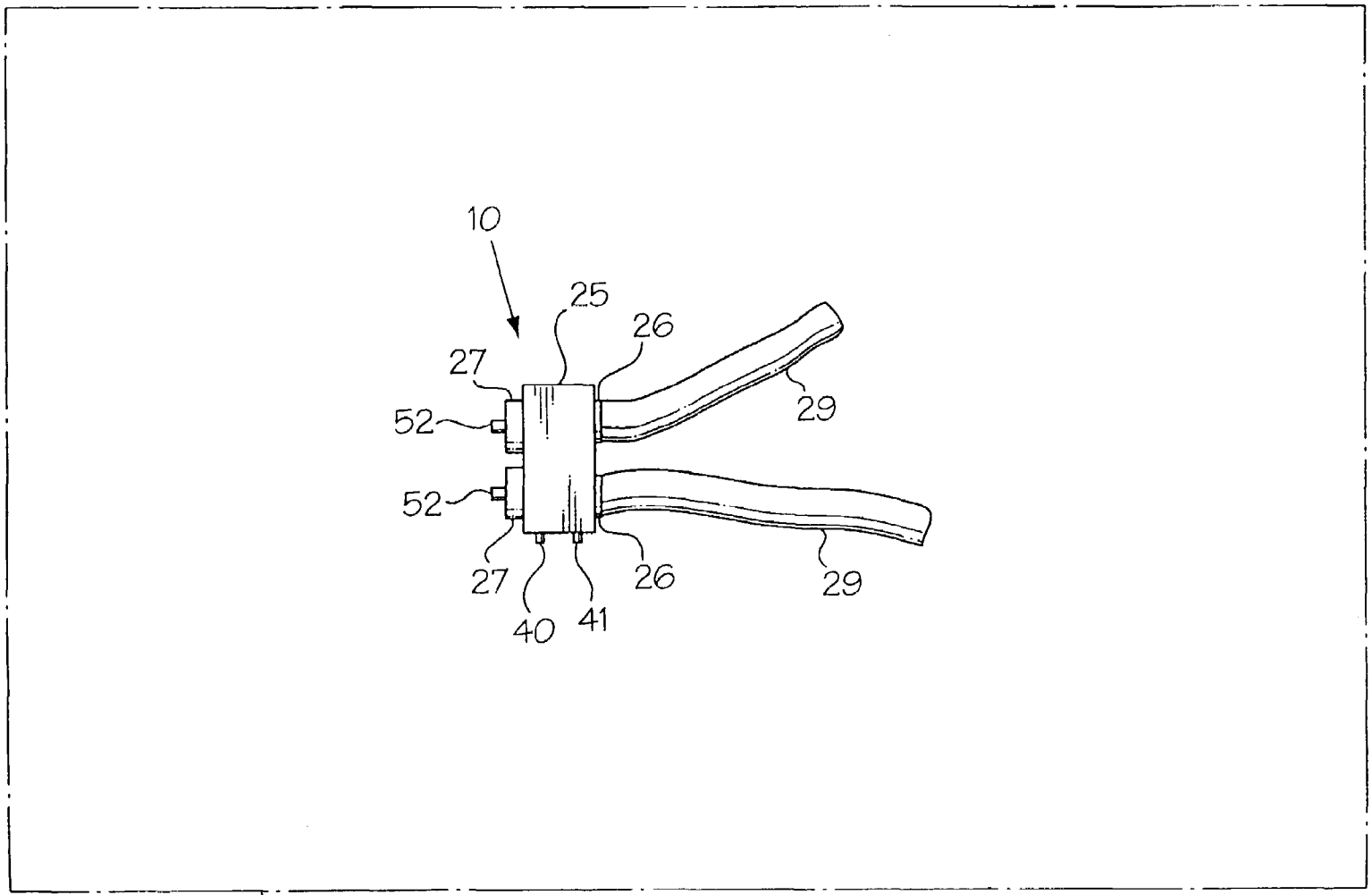
FIG. 2 is an isometric view of one side of a modular heat exchange unit used in the system of the present invention.

Referring to FIG. 2, the heat exchange unit indicated generally at 10 is mounted in an attic 23. The unit 10 includes a casing 25 with a pair of air inlet sleeves 26 and a pair of fans 27 for discharging air from the unit. An elongated, flexible, metal duct 29 is attached to each inlet sleeve 26 for introducing warm attic air into the casing 25. The ducts 29, which can be of different lengths, extend a long distance from the casing 25 and are used to draw in hot air from areas of the attic 23 remote from the casing 25. This arrangement ensures that cooler air discharged via the fans 27 is not immediately recirculated through the inlet 26 into the casing 25.

Figure 3:
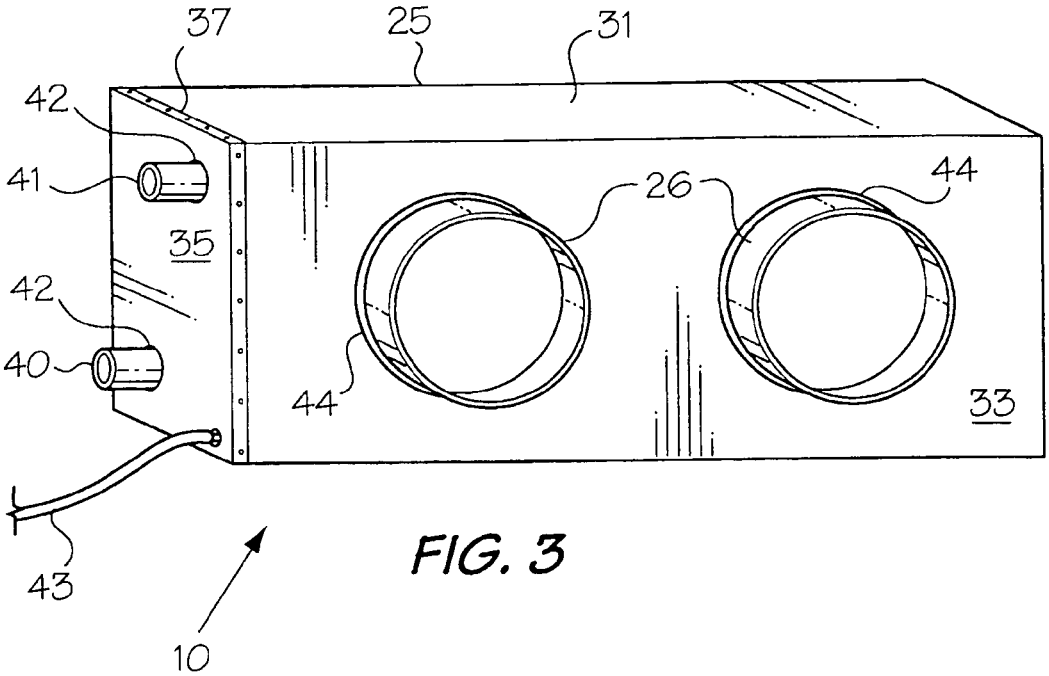
FIG. 3 is an isometric view of the heat exchange unit of FIG. 2 from the other side thereof.
Figure 4:
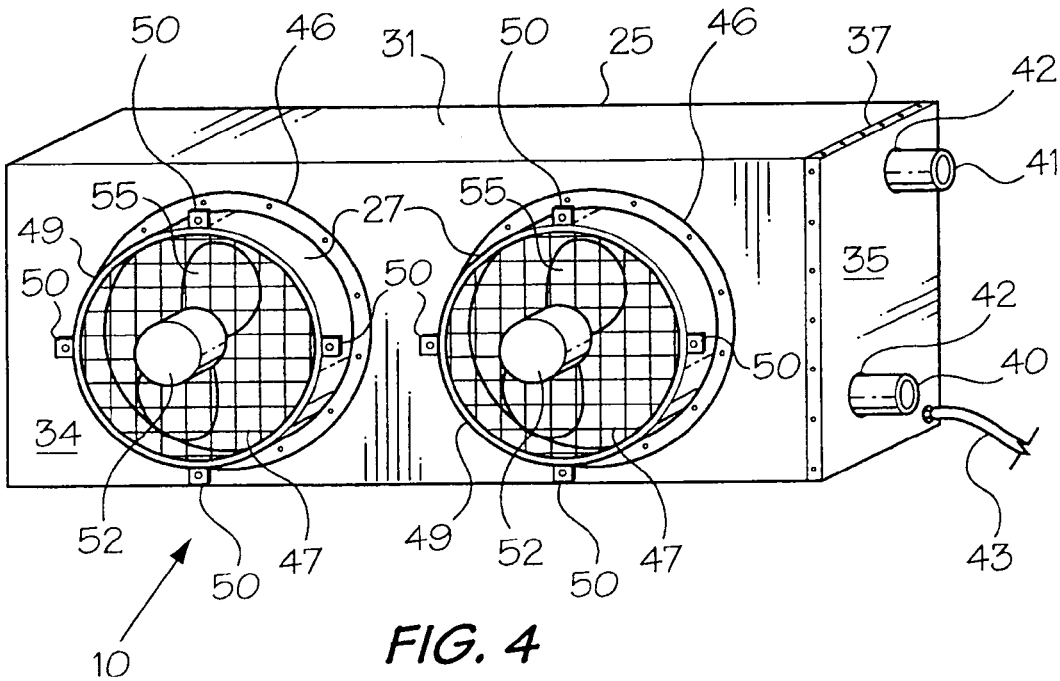
FIG. 4 is a schematic, exploded, end view of the heat exchange unit of FIGS. 2 and 3.
Figure 5:
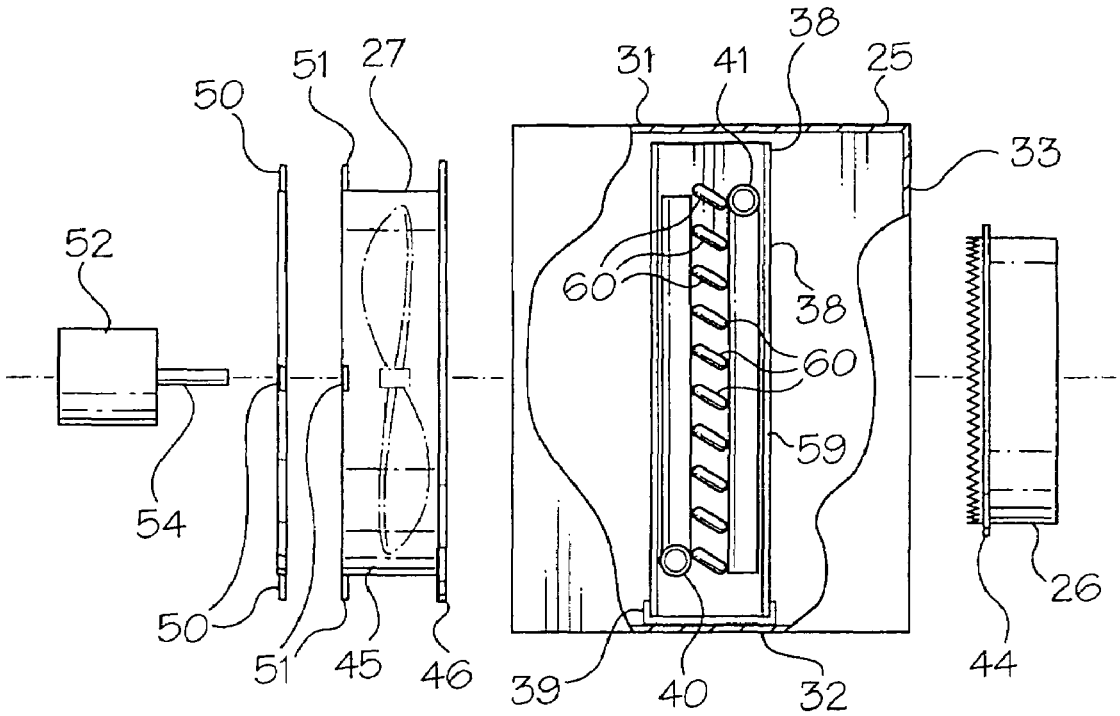
FIG. 5 is a partly sectioned front view of a heat exchanger used in the unit of FIGS. 2 to 4.
Figure 6:
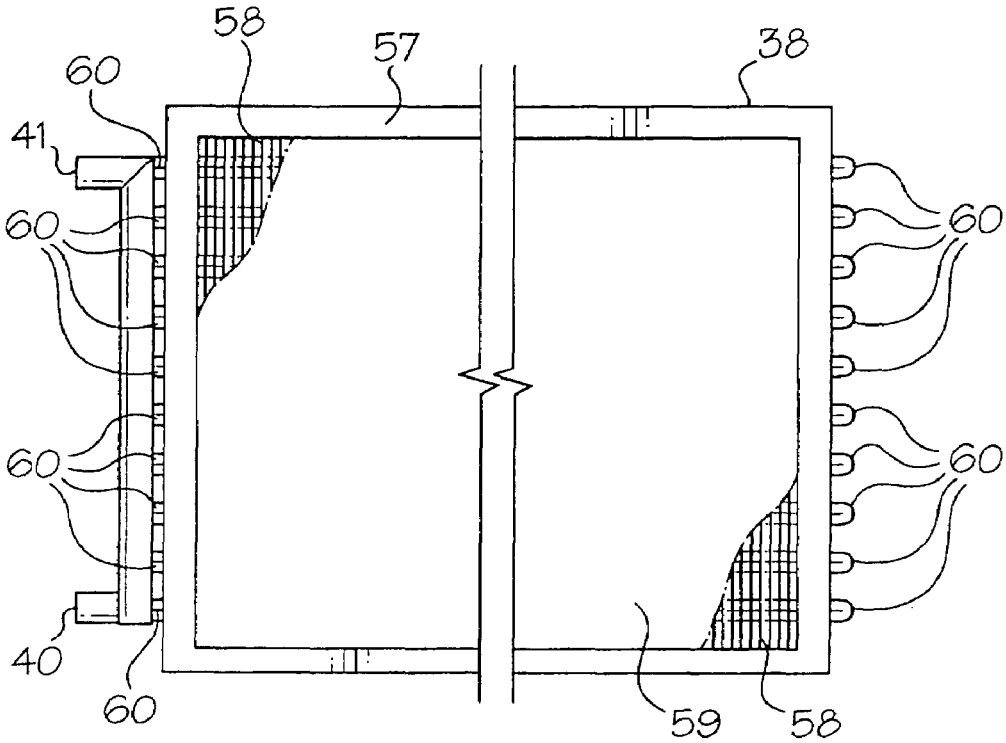
FIG. 6 is a partly sectioned top view of the heat exchanger of FIG. 5.
Figure 7:
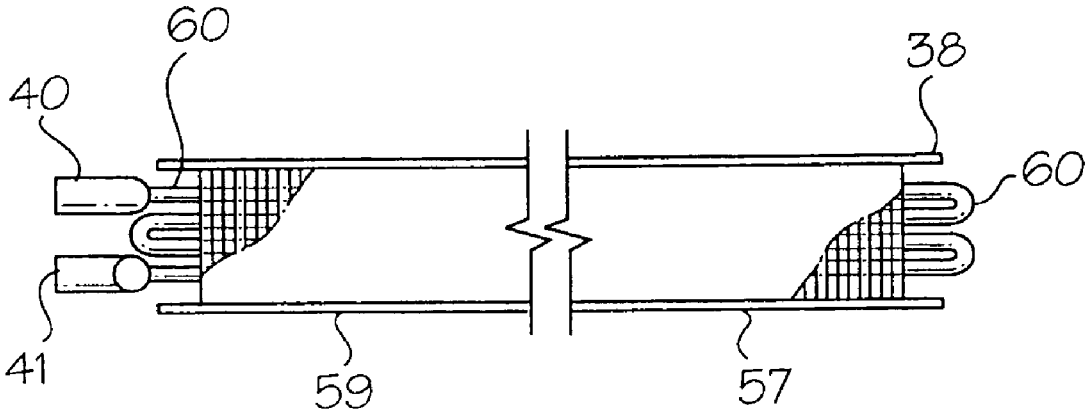
FIGS. 7 and 8 are end views of the heat exchanger of FIGS. 5 and 6.
Figure 8:
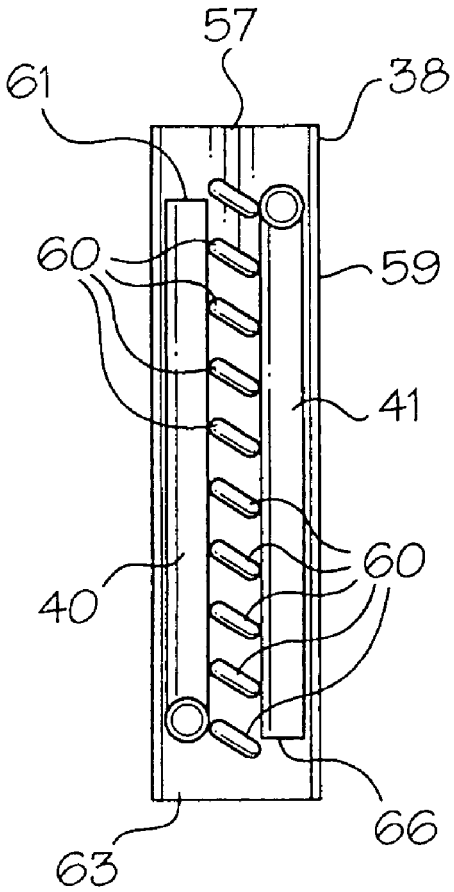
Figure 9:
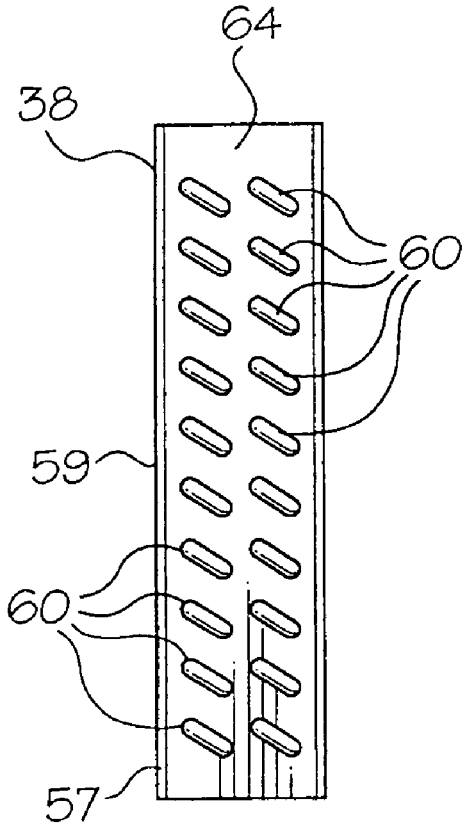
FIG. 9 is a schematic top view of the heat exchange unit and air inlet tubes located in an attic.

As best shown in FIGS. 3 to 5, the casing 25, which is formed of steel sheets, is defined by a top wall 31, a bottom wall 32 (FIG. 5), a front wall 33, a rear wall 34, and a pair of end walls 35 (one shown). One of the end walls 35 defines a cover with a flange 37 around the periphery for connecting the wall to the remainder of the casing 25 to allow for the mounting of a heat exchanger 38 (FIG. 5) in the casing 25.

A U-channel 39 is provided on the bottom wall of the casing 25 for receiving the heat exchanger 38. With the heat exchanger 38 installed in the casing 25, the cover or end wall 35 is replaced, so that inlet and outlet manifolds 40 and 41, respectively of the heat exchanger 38 extend outwardly through holes 42 (FIGS. 3 and 4) in the cover. A drain tube 43 is connected to a drain outlet at the bottom of the wall 35. The tube 43 extends from the casing 25 out of the attic to the outdoors for draining water in the event of a leak on the heat exchanger 38 or the pipes in the casing.

Air enters the casing 25 via the inlets 26. The inlets 26 include narrow flanges 44 (FIG. 3) near the inner end thereof for limiting movement thereof into the casing 25. The inlets 26 are connected to the casing by crimped connectors, i.e. the inner end of each inlet 26 is serrated, and after the inlet is inserted into the casing front wall 33, alternate serrations are bent or crimped to hold the inlet on the casing 25. Air entering the casing 25 via the inlets 26 passes through the heat exchanger 38 and is discharged via the fans 27. Each fan 27 (FIGS. 4 and 5) includes a cylindrical casing 45 with a flange 46 on one end thereof for mounting the fan over an opening (not shown) in the wall 33 of the casing 25. A grill 47 is mounted on the other end of the fan casing 45. The grill 47 includes an annular rim 49 with ears 50 (FIG. 5) extending outwardly therefrom. Bolts and nuts are used to connect the ears 50 to similar ears 51 on the outer, free end of the casing 45. A motor 52 is mounted on an annular hub (not shown) in the center of the grill 47. The shaft 54 of the motor 52 extends into the casing 45 through a hole in the hub the casing 45 and carries an impeller defined by blades 55 on the inner free end thereof.

Referring to FIGS. 5 to 9, the heat exchanger 38 includes a hollow, rectangular casing 57 carrying a plurality of fins 58 defining horizontal passages for air entering the front end 59 of the casing 57 via the inlets 26. Water flowing through the pipe 8 (FIG. 1) from the pool is introduced into tubes 60 via the inlet manifold 40, which is L-shaped with a closed top end 61. Ten tubes 60 extend back and forth across the casing 57 between the inlet and outlet manifolds 40 and 41, respectively. Each water tube 60 enters one side 63 of the casing 57, extends across the casing, exits the side 63, extends across the casing through the side 64, and finally loops back through the casing to the outlet manifold 41. The outlet manifold 41 has an inverted L-shape with a closed bottom end 66. Thus, each tube 60 makes four passes through the casing 57 of the heat exchanger 38, resulting in maximum heat exchange between the hot attic air and the swimming pool water passing through heat exchanger.

The use of two fans 27 and a modular structure makes it possible to use smaller components than would otherwise be the case. The main casing 25 is designed to fit through attic openings having conventional dimensions. The casing 25 with or without the heat exchanger 38 can be placed in an attic, and then the air inlet sleeves 26 and the fans 27 attached thereto, i.e. the inlet sleeves and the fans 27 are introduced separately for assembly in the attic.

In a typical system, the casing 25 is 48" long by 22" high by 14.5" deep which allows access to most attic hatch openings. The inlet sleeves 26 are 14" fish lock collars, crimp connected to the casing 25. The ducts 29 are secured to the sleeves 26 using flexible duct tape or nylon draw tight connectors. The ducts 26 are stretched out and positioned as far as possible from the casing 25 to maximize hot air intake while ensuring minimum cooler air recirculation through the heat exchanger. The heat exchanger 38 is a custom designed copper tube and aluminum finned assembly with dimensions of 47.5" long, 21" height and 8.5" depth. The finned face area measures 42"×18". With such dimensions, the system is able to provide approximately 50,000 btu per hour at an air/water temperature difference of approximately 20° F. As the temperature differential increases, the output and efficiency also increase.

What is claimed is:

1. A modular swimming pool water heating system comprising a casing for mounting in an attic of a building;

a heat exchange unit for removable mounting in said casing;

an opening in said casing permitting access to the interior of the casing for receiving said heat exchange unit when the casing is mounted in an attic;

a cover removably mounted on said casing for closing said opening, whereby said heat exchange unit can readily be mounted in said casing;

an inlet manifold on said heat exchange unit for introducing swimming pool water into said heat exchange unit, said inlet manifold extending through said cover on said casing when the casing is closed;

an outlet manifold on said heat exchange unit for returning water to a swimming pool, said outlet manifold extending through said cover on said casing when the casing is closed;

inlet sleeves for removable attachment to one side of said casing for introducing air into the casing;

fan units for removable mounting on a second side of said casing opposite said one side for drawing air into said casing and through said heat exchange unit; and elongated, flexible, ducts for connection to said inlet sleeves for receiving warm attic air from locations remote from said casing and feeding said air to said casing for passage through said heat exchange unit to heat any pool water circulating therethrough.

2. The system of claim 1, including:

a first sensor for monitoring the temperature of air in an attic;

a second sensor for monitoring the temperature of water flowing from a swimming pool through said heat exchanger; and a controller connected to both said sensors and said fan units for actuating the fan units only when the difference between the temperatures monitored by said first and second sensors reaches a predetermined level.

3. The system of claim 2, wherein said predetermined level is approximately 20° F.

* * * * *